US008820241B2

(12) United States Patent
Kautzsch et al.

(10) Patent No.: US 8,820,241 B2
(45) Date of Patent: Sep. 2, 2014

(54) SAFETY DEVICE FOR A FUZE OF A PROJECTILE

(75) Inventors: Karl Kautzsch, Schwanstetten (DE); Siegfried Lauble, Hardt (DE); Robert Hüttner, Neetze (DE); Andreas Schellhorn, Schramberg (DE)

(73) Assignee: Junghans Microtec GmbH, Dunningen-Seedorf (DE)

( * ) Notice: Subject to any disclaimer, the term of this patent is extended or adjusted under 35 U.S.C. 154(b) by 13 days.

(21) Appl. No.: 13/503,098

(22) PCT Filed: Nov. 5, 2010

(86) PCT No.: PCT/EP2010/006743

§ 371 (c)(1), (2), (4) Date: Apr. 25, 2012

(87) PCT Pub. No.: WO2011/072774

PCT Pub. Date: Jun. 23, 2011

(65) Prior Publication Data

US 2012/0240805 A1 Sep. 27, 2012

(30) Foreign Application Priority Data

Dec. 17, 2009 (DE) ..... 10 2009 058 718

(51) Int. Cl.
*F42C 15/24* (2006.01)
*F42C 15/40* (2006.01)

(52) U.S. Cl.
USPC ..... 102/247; 102/215; 102/216; 102/248; 102/262

(58) Field of Classification Search
USPC ..... 102/215, 221, 222, 231, 232, 247, 248, 102/262, 264, 216
See application file for complete search history.

(56) References Cited

U.S. PATENT DOCUMENTS

| | | | | |
|---|---|---|---|---|
| 3,332,354 | A | 7/1967 | Silvers, Jr., et al. | |
| 3,672,302 | A * | 6/1972 | Shaw | 102/262 |
| 3,851,531 | A * | 12/1974 | White et al. | 73/510 |
| 4,096,802 | A | 6/1978 | Waln | |
| 5,756,927 | A * | 5/1998 | Fixell et al. | 102/264 |
| 5,918,308 | A * | 6/1999 | Hunter | 89/6.5 |
| 6,129,022 | A * | 10/2000 | Hickey et al. | 102/221 |
| 7,191,707 | B1 | 3/2007 | Davis | |
| 7,980,179 | B2 * | 7/2011 | Harbrecht et al. | 102/222 |

FOREIGN PATENT DOCUMENTS

| | | |
|---|---|---|
| DE | 39 25 000 C1 | 9/1997 |
| DE | 695 23 637 T2 | 7/2002 |

OTHER PUBLICATIONS

English Translation of the "Written Opinion of the International Searching Authority" for PCT/EP2010/006743; Jul. 3, 2012, pp. 1-5.*

* cited by examiner

*Primary Examiner* — James Bergin
(74) *Attorney, Agent, or Firm* — Laurence A. Greenberg; Werner H. Stemer; Ralph E. Locher

(57) ABSTRACT

A safety device for a fuze of a projectile that includes a detonating device for detonating the fuze. The safety device has a safety unit with a processor for safeguarding a detonation process of the detonating device. The safety unit contains a sensor unit configured to output a disengagement signal at a predetermined acceleration state. The processor is set up to output a control signal to release the safety unit in accordance with the presence of the disengagement signal. A low-acceleration state of the flight of the projectile can thus be detected and used as release parameter.

14 Claims, 3 Drawing Sheets

SAFETY DEVICE FOR A FUZE OF A PROJECTILE

BACKGROUND OF THE INVENTION

Field of the Invention

The invention relates to a safety device for a fuze of a projectile, which has a firing device for firing the fuze, comprising a safety unit having a process means for making a firing process of the firing device safe.

A safety device for a fuze is used to prevent inadvertent activation of a main charge of a projectile, although it is intended to be possible to activate the main charge after arming. For this purpose, the safety device is a component of a fuze for firing the main charge, which fuze can be provided with a firing chain comprising two or more firing means. The first firing means is activated first of all in order to fire the main charge, for example a piercing-sensitive minidetonator which is pierced by a piercing needle. Explosion energy of the first firing means is transmitted through an appropriate arrangement of the first two firing means to the second firing means, which may be in the form of a firing booster. This can transmit its explosion energy to an initial charge or main charge.

Previous fuzes, in particular for simple projectiles such as mortar shells, have a safety-brake plug as the first safety means and an apparatus which detects the launch shock as the second safety means. The disadvantage of these safety means is that the safety-brake plug must be manually removed before loading the mortar shell. Relatively frequently, withdrawal of the safety-brake plug is forgotten, and the mortar shell becomes a misfire.

BRIEF SUMMARY OF THE INVENTION

One object of the present invention is to specify a safety device for a fuze of a projectile which unlocks the safety means by using a physical arming parameter which is independent of a firing parameter, without having to withdraw a safety-brake plug.

This object is achieved by a safety device of the type mentioned initially, in which the safety device contains a sensor unit which is designed to output an enable signal when an acceleration state is found, with the process means being designed to output a control signal, in order to arm the safety unit, as a function of the presence of the enable signal. The object is also and in particular achieved by a safety device for a fuze of a projectile which has a firing chain for firing the fuze and an interruption means for interruption of the firing chain, with the safety device comprising a sensor unit which is designed to output an enable signal in the event of an acceleration state in the fuze which is below the earth's acceleration due to gravity by at least a defined acceleration value, and a process means which is designed to output a control signal for arming the interruption means as a function of the presence of the enable signal.

The lack of weight or a state of little weight, that is to say low acceleration, can be used to arm the fuze. This parameter is dependent on a launch parameter and can be used to achieve a high degree of safety against inadvertent firing, for example in conjunction with the use of a launch parameter.

Since ballistic flight is characterized by an essentially weightless state of the projectile, the sensing of the weightless state or a state with little acceleration can be used as an arming parameter. If an acceleration sensor registers a predetermined acceleration state in the fuze or of the fuze which, for example, is well below the earth's acceleration due to gravity, then the presence of the flight phase can be deduced from this, and the interruption means can be armed.

The invention is particularly suitable for ballistic missiles such as projectiles, in particular mortar shells, rockets with an undriven flight phase, bombs and the like. Ballistic missiles fly over a flight path which is characterized approximately by a flight parabola and in which the missile—apart from the deceleration caused by drag in the air—is in a weightless state.

The firing device may contain a firing charge, and in particular it may be part of or may contain a firing chain for firing the fuze. The safety unit is used to make the firing process safe, in particular to make it safe against inadvertent arming of the fuze. It may be configured purely electronically, for example by processing signals from sensors which measure physical parameters and initiating arming by outputting a control signal when a predetermined signal state is present, to be precise an appropriate physical state of the fuze. In another embodiment or in addition to the described electronic variant, the safety unit may comprise mechanical safety means, for example an interruption means for interruption of the firing chain. The interruption means may be used to receive and/or divert firing energy of a firing means, such that firing of the further firing means by firing energy from the first firing means is reliably suppressed. The interruption means may be a barrier, a means for misalignment of two firing means or any other desired means for prevention or interruption of a firing process by the firing chain. The interruption means may comprise a plurality of safety means which unlock a barrier and advantageously have to be activated independently of one another.

In one advantageous embodiment of the invention, the firing device comprises a firing chain with a firing charge for firing the fuze, and the safety unit comprises an interruption means for interruption of the firing chain. This allows a firing process to be made safe mechanically in a simple manner.

The acceleration state may be the instantaneous acceleration of the sensor unit and/or of the fuze. The defined acceleration state is, in particular, an acceleration state in the fuze. It is below the earth's acceleration due to gravity by at least a defined acceleration value, that is to say it is below a limit value which is below the acceleration due to gravity, and may be any value below the acceleration due to gravity or the earth's acceleration due to gravity, which is approximately 9.81 $m/s^2$. An acceleration range below the earth's acceleration due to gravity is also possible, for example between 0 $m/s^2$ and 5 $m/s^2$. The defined acceleration state in the longitudinal direction or direction of flight of the projectile is advantageously below 5 $m/s^2$, and expediently it is below this value in all three spatial directions, in particular with the total acceleration being below this value. The defined acceleration state, limit value or acceleration value can be stored by an appropriate setting in the safety device, for example the sensor unit and/or the process means, or in another unit.

The sensor unit expediently contains an acceleration sensor which can be designed to measure the instantaneous acceleration, for example in the fuze. The acceleration can be measured on the basis of a force which acts on the acceleration sensor as the result of gravity, and/or as the result of a change in the velocity of the sensor during its movement through space. The sensor unit can measure the acceleration state as a one-dimensional acceleration. The acceleration state is expediently measured multi-dimensionally, in particular three-dimensionally.

Expediently, the sensor unit is designed such that an enable process starts as soon as the acceleration state falls below the limit value. The enable process may be started by one or more signals which are output when the acceleration falls below the limit value. The enable process leads to the enable signal, but possibly only when further conditions have been satisfied, for example the acceleration state is below the limit value for a predetermined time period or it is terminated, for example when the acceleration state rises too quickly above the limit value again.

The process means is designed to check for the presence of the enable signal and to output the control signal for arming as a function of its presence. Such a design can be implemented by an appropriate control program whose running—for example in conjunction with the input signals from the acceleration sensor—results in such control. The control signal is expediently an electrical signal on a data line which, in conjunction with an appropriate arming apparatus, can trigger arming. In addition, the enable signal is expediently an electrical signal which is transmitted via a data line to the process means.

In a further advantageous embodiment of the invention, the sensor unit is designed to measure three directional accelerations in three mutually orthogonal spatial directions. This makes it possible to calculate a total acceleration or an acceleration state in the fuze in a simple manner from the three directional accelerations.

Advantageously, the enable signal is produced only when each of the three directional accelerations is below the earth's acceleration due to gravity, in each case at least by a defined acceleration value. By way of example, the sensor unit may for this purpose comprise a logic AND operation, which is satisfied only when every directional acceleration is below the acceleration due to gravity at least in each case by a defined acceleration value.

It is also proposed that the defined acceleration value be different in the direction of flight than the defined value in the two other directions, which are expediently orthogonal to it. Whether the defined acceleration value in the direction of flight is chosen to be greater or below the defined value in the two other directions may be made dependent on the missile or on mission data. If the missile is possibly subject to a greater unbalance or vibration during flight, it is advantageous to choose the values at right angles to the direction of flight to be greater, in order to ensure arming during flight despite the disturbances. If the missile is very fast, then it also experiences a relatively large negative acceleration during the intrinsically weightless ballistic flight, because of the drag from the air, thus permanently decelerating it. In this case, the value in the direction of flight may be chosen to be greater in order that the enable signal can be produced even when the acceleration state in the direction of flight is still somewhat greater.

A further advantageous embodiment of the invention provides that the defined acceleration state is below the earth's acceleration due to gravity by at least a defined acceleration value, and the process means is designed to monitor the acceleration value in the direction of flight and to identify an absolute minimum in the profile of the acceleration value. The absolute minimum indicates the least drag from the air during flight, and also indicates that the apex point of the flight path of the projectile has been reached. If the presence of this absolute minimum is used as an arming criterion, which must be present in order to output the control signal, in particular at the same time as the presence of the enable signal, the control signal is produced only once the projectile path has passed through the apex point. This ensures a high degree of short-range safety. Correspondingly, the process means checks for the presence of the minimum before it outputs the control signal.

A simple check that the magnitude of the value of the acceleration state is below the limit value, that is to say that it is below the earth's acceleration due to gravity by at least the defined acceleration value, can be achieved by means of a comparator which allows the acceleration value or limit value to be adjusted. A signal from an acceleration sensor can thus be compared with a preset value, and an appropriate enable signal can be output if the defined signal value is overshot or undershot.

In order to improve safety, it is advantageous if brief and inadvertent falling of the projectile does not lead to arming of the safety device but that the enable signal is still used as such only when the weightless or low-weight state is present for a defined time interval. For this purpose, the safety device advantageously comprises a timing element for presetting a time interval, with the process means expediently outputting the control signal only when the enable signal is present, in particular without interruption, throughout the time interval.

The timing element may be part of the sensor unit, part of the process means or may be formed separately. A particularly cost-effective circuit can be achieved if the timing element is designed to block the enable signal from the sensor unit throughout the time interval. The timing element can be produced particularly cost-effectively and reliably by means of an RC element and a potential evaluator in the RC element. The time interval is expediently greater than one second, in order that a free fall must last for more than 5 m in order to allow the enable signal to be used to produce the control signal. If the time interval is greater than 2 seconds, an arming drop must be more than around 19.62 m.

A further advantageous embodiment of the invention is based on the following considerations. When using a three-axis acceleration sensor, a low-force state of the fuze can be identified during the flight of the projectile. The low-force state may be characterized by an acceleration state in which the total acceleration of the fuze is below the limit value. This makes it possible to distinguish between a "flight" state and a "ground" state, in order to produce the control signal as an arming criterion, in particular as a further arming criterion following a first arming criterion.

Generally, projectiles rotate about their longitudinal axis, during flight, even when they are fired without spin. A normal roll rate is up to 2 revolutions per second, with modern munitions being caused to rotate at up to 20 revolutions per second during flight for flight stabilization, by means of a fin structure. If the sensor unit does not lie exactly on the rotation axis of the projectile during flight, then it is subject to a centrifugal force during rolling of the projectile in the air, which is evident as lateral acceleration and is measured in a corresponding manner by the sensor unit.

Mechanically, the sensor unit can be mounted sufficiently accurately on the longitudinal axis of the projectile, since manufacturing tolerances can be kept low. However, the geometric longitudinal axis of the projectile generally does not coincide with the rotation axis of the projectile, that is to say the axis about which the projectile rolls during flight. The discrepancy may result from asymmetric loading of the projectile with other components and in particular explosives, which draw the center of gravity of the projectile away from the geometric longitudinal axis. Such an unbalance can lead to disturbing lateral acceleration values on the sensor unit at high roll rates, which decrease the reliability of the output of a control signal for arming.

If the sensor unit has a roll sensor which is designed to identify rolling of the projectile and to output a roll signal when a rolling movement of the projectile is present, then the rolling can be identified and can be processed as additional information, for example by the process means, in order to output the control signal for arming. The process means is expediently designed to output the control signal for arming as a function of the presence of the roll signal.

Rolling of the projectile can be distinguished from spinning of projectiles. While spinning normally takes place at more than 100 Hz, rolling takes place at below 100 Hz. In the following text, rotation between 1 Hz and 50 Hz, in particular between 2 Hz and 25 Hz is defined as rolling, while spinning is defined as being above 50 Hz. The roll sensor identifies rolling of the projectile without spin, and also outputs the roll signal when the projectile is not spinning.

If rolling of the projectile, that is to say a rolling movement of the projectile in the air, is identified which satisfies a predetermined characteristic, then this can be used to unambiguously identify the "flight" state. The predetermined characteristic is expediently chosen such that it characterizes the "flight" state with predetermined adequate safety. The roll signal therefore provides a further signal in addition to the enable signal, and this can be used as a trigger for arming. Correspondingly, it is advantageous for the process means to be designed to check both the enable signal and the roll signal for their presence, and to output the control signal for arming when at least one of the two signals is present. A logic OR circuit applied to the two signals can be used to output the control signal for arming, indicating whether one signal or the other is present. The control signal can also be output when both signals are present at the same time.

Although the sensor unit in the projectile may experience lateral acceleration due to an unbalance in the projectile during flight, the longitudinal acceleration is, however, always low. This is predetermined only by the deceleration caused by the drag from the air. It is therefore advantageous for the "flight" state as identified by the roll signal to be verified by checking the longitudinal acceleration, that is to say the acceleration of the fuze in the direction of flight, in the direction of its longitudinal axis, or in the axial direction. Therefore, the process means is expediently designed to check, when the roll signal is present, whether the acceleration of the projectile in the axial direction is below a predetermined value, and to output the control signal for arming only when the value has been undershot.

The roll sensor is expediently an acceleration sensor which, in particular, is not arranged on the geometric longitudinal axis of the projectile. If this experiences a permanent acceleration, that is to say for more than a predetermined time period, above the earth's acceleration due to gravity or, more generally: above a predetermined value, then this is an indication of the presence of the "flight" state. The roll signal can be output to the process means. Alternatively, a magnetic field sensor can be used which senses the earth's magnetic field and uses the relative rotation of the earth's magnetic field to identify rolling, and therefore the "flight" state. A gyroscope or a revolution counter is likewise advantageous.

In order to improve the safety of identification of the "flight" state, it is advantageous for the process means to be designed to use signals, in particular to use signals from the sensor unit, to distinguish between free-flight rolling of the projectile and rolling of the projectile on a base. A distinction such as this can be drawn on the basis of measurements of the lateral acceleration over time. In the case of free-flight rolling, these are constant, possibly even zero or close to zero, while in contrast ground rolling is characterized by alternating lateral acceleration values in the orthogonal lateral directions. The signals are therefore expediently signals which have been obtained from the measurement of the lateral acceleration of the projectile or of the fuze. An appropriate acceleration sensor is provided for this purpose, in particular as part of the sensor unit.

When ground rolling occurs, the output of a control signal for arming the interruption means should expediently be prevented. For this purpose, it is advantageous for the sensor unit to have a ground rolling sensor, which is designed to identify ground rolling of the projectile on a base, and to output a ground rolling signal in the event of ground rolling. Ground rolling may be a rolling movement with a lateral acceleration of the projectile, which is related in a predetermined manner to the rolling movement. The process means is expediently designed to suppress the output of the control signal for arming of the interruption means when the ground rolling signal is present. Suppression also means that the control signal is not output irrespective of whether it has already been produced in an upstream signal stage. The ground rolling sensor may be a part of the sensor unit, or may be formed separately.

The invention also relates to a fuze of a projectile which has a safety device as described above.

In addition, the invention relates to a method for arming a fuze of a projectile, which has a firing device for firing the fuze and a safety device with a safety unit which contains a process means for making a firing process of the firing device safe. According to the invention, a sensor unit outputs an enable signal when a defined acceleration state occurs, and a control signal for arming the safety unit is output as a function of the presence of the enable signal. In particular, the invention relates to method for arming of a fuze of a projectile, which has a firing chain for firing the fuze and an interruption means for interruption of the firing chain. According to the invention, a sensor unit is used to detect an acceleration state in the fuze after which the acceleration state has fallen below the earth's acceleration due to gravity by at least a defined acceleration value, an enable signal is output, and the interruption means is armed as a function of the presence of the enable signal.

Further advantages will become evident from the following drawing description. The drawing illustrates exemplary embodiments of the invention. The drawing and the description contain numerous features in combination, which a person skilled in the art will also expediently consider individually and combine to make worthwhile further combinations.

DESCRIPTION OF THE INVENTION

Figure 1:
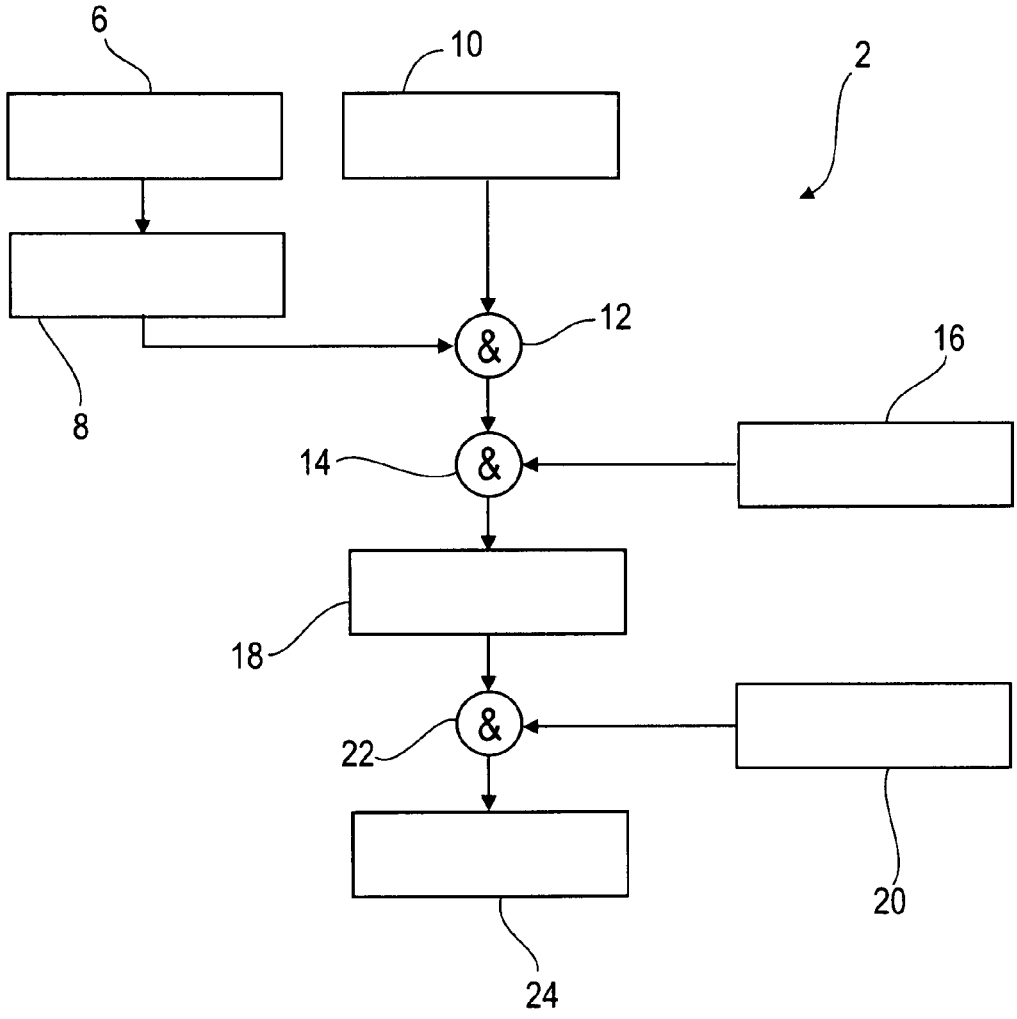
FIG. 1 shows an overview illustration of a safety device.

FIG. 1 shows an overview of a safety device 2 for a fuze 4 (FIG. 2) of a projectile. Launching of the projectile is identified by a first safety means 6, for example a double-bolt system. Its arming sets in train a further safety means 8, in this exemplary embodiment of a timing element, which ensures a safe separation distance. A third safety means 10, which may be a sensor unit for measurement of an acceleration state, identifies a low-acceleration flight state and outputs an appropriate signal. This is passed together with an effect of the timing element to an AND logic 12, which may be in mechanical or electronic form. The action may be mechanical, for example by means of a mechanical enable, or an electrical signal. The action of the AND logic 12 is passed to a further AND logic 14, on which a third safety means 16 also acts, for example a further timing element. The AND logic 14 acts on a means 18 for arming the fuze 4, for example such that a force element is armed. The fuze 4 is fired 24 by a fire signal 20 which must coincide with an armed state of the fuze 4 by the means 18—corresponding to the further AND logic 22.

Figure 2:
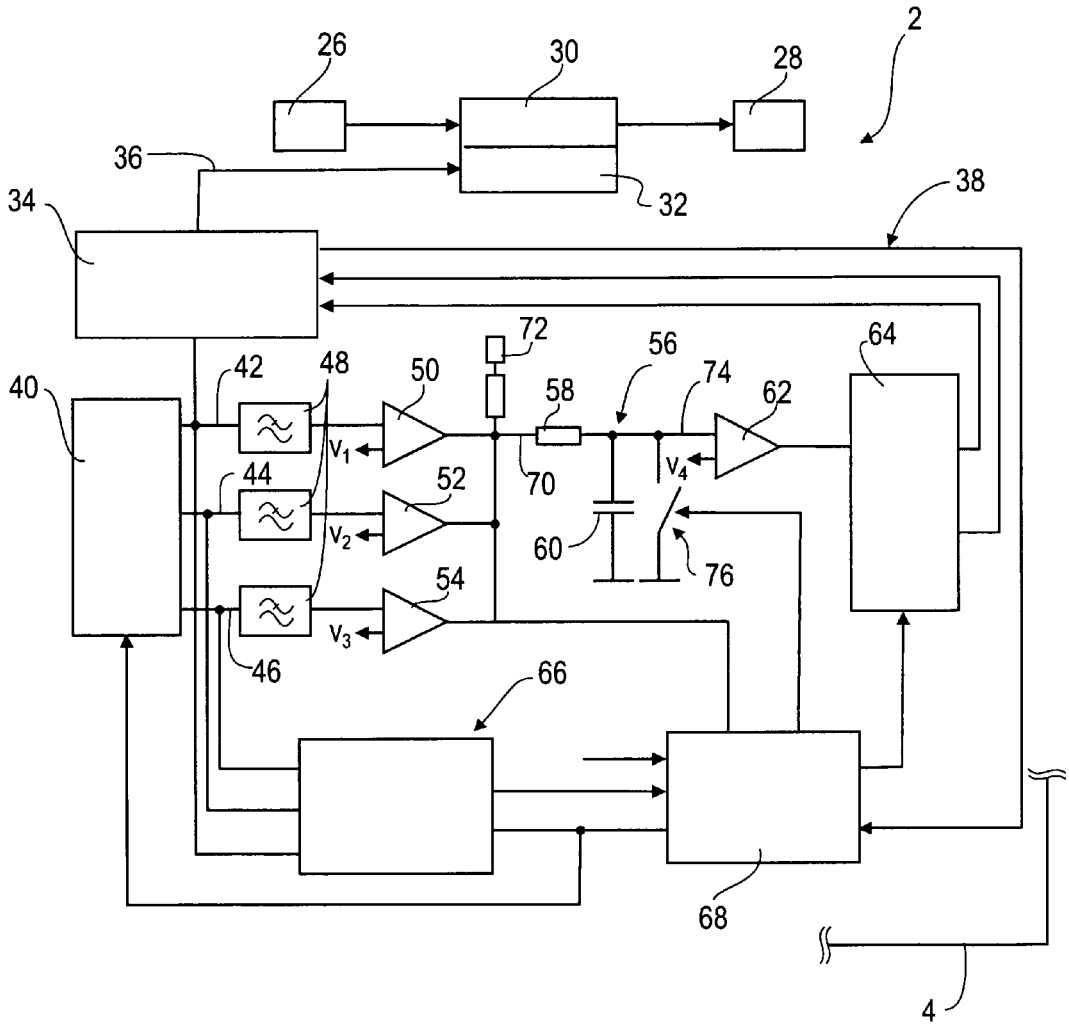
FIG. 2 shows a circuit illustration of a safety device for a fuze.

The safety device 2 from FIG. 1 is shown in the form of a circuit diagram illustration in FIG. 2. This is concealed in the fuze 4, which comprises a firing chain having two firing means 26, 28, with the firing means 26 using firing energy to fire the firing means 28. In order to interrupt the firing chain, the fuze 4 may comprise an interruption means 30, for example in the form of a moving barrier, which can be pivoted out of the firing chain by a mechanism 32, such that the firing means 26 can flash over to the firing means 28. The mechanism 32 is operated by a process means 34 via a signal line 36, on which the process means 34 sends a control signal for arming the interruption means 30 to the mechanism 32, which converts the control signal to a mechanical movement to move the interruption means 30 out of the firing chain.

Although the illustrated exemplary embodiment does not specifically describe the nature of the safety means 6, 8, 16, of the firing of the fuze and of making the firing process safe, the invention is, however, not restricted to this specific means. In fact, it is equally possible to use a greater or lesser number and/or other safety means and to dispense with the firing chain and in particular with the interruption means, and to use a different fuze and, in particular, interruption. In particular, electronically controlled firing and/or purely electronic interruption of a firing process are/is feasible.

The process means 34 is connected to a sensor unit 38 which is an acceleration sensor unit. This is in the form of a low-g sensor unit, which identifies an acceleration state in which the magnitude of the total acceleration, for example in the fuze 4, is below the earth's acceleration due to gravity, that is to say below the g-value of around 9.81 $m/s^2$. This is therefore expediently an acceleration sensor which reacts to a total acceleration whose magnitude is below the earth's acceleration due to gravity by a defined value. The sensor unit 38 comprises a sensor 40 with three outputs 42, 44, 46, each having a filter 48, three comparators 50, 52, 54, a timing element 56 with a non-reactive resistor 58 and a capacitor 60 as well as a comparator 62. An output stage 64, which may be part of the process means 34, is designed to output an enable signal. Furthermore, the safety device 2 comprises a self-test unit 66 with a controller 68.

The figure does not show a further safety device in the form of a double-bolt system, which is initiated in response to launching of the projectile and enables the interruption means 30 shortly after launch. In this case, the interruption means 30 is still blocked by the mechanism 32, as a result of which the firing chain is still interrupted.

During operation, the sensor 40, which is a three-axis acceleration sensor, measures the acceleration in three orthogonal spatial directions, specifically in the direction of flight of the projectile, that is to say parallel to its longitudinal axis, and in two lateral directions, which are mutually perpendicular and are at right angles to the direction of flight. As a result of its measurement, it outputs an output signal for each spatial direction, which output signal is related in a known manner to the acceleration of the sensor 40 in the appropriate spatial direction. The three signals are output at the three outputs 42, 44, 46, with the sensor 40 being mounted in the safety device or in the fuze 4 such that the signal is present at the output 42 indicating the acceleration of the fuze 4 or of the safety device 2 in the direction of flight of the projectile. The two signals which correspond to the acceleration of the sensor 40 in the lateral directions are produced at the two other outputs 44, 46.

The three signals are each filtered by one of the filters 48, which is a low-pass filter. This filter 48 filters the high-frequency component out of the signal above, for example 100 Hz. This at least largely eliminates the noise and the disturbance caused by vibration of the projectile on the acceleration signal. The filtered signals are passed to the three comparators 50, 52, 54. The respective corresponding signal and a respective comparison signal $v_1$, $v_2$, $v_3$ are therefore applied to their inputs, with the comparators 50, 52, 54 respectively comparing the signals. In this case, the comparison signals $v_1$, $v_2$, $v_3$ form threshold values. For example, if the input signal to the comparator 50 from the filter 48 remains at an electrical potential below the comparison signal $v_1$, then the output signal from the comparator 50 is, for example, at a negative or low voltage value with respect to ground, or some other reference potential value. If the signal from the filter 48 is greater than the comparison signal $v_1$, then the output signal from the comparator 50 is, for example, a positive or higher voltage.

The signals from the outputs 42, 44, 46 correspond to the respective acceleration of the sensor 40 in a spatial direction, with the sensor 40 outputting the signals in inverted form. The higher the acceleration is in one direction, the lower is the signal at the corresponding output 42, 44, 46. The comparison signal $v_1$, $v_2$, $v_3$ therefore form limit values or threshold values, with the respective output signal from the comparators 50, 52, 54 changing, for example, from a negative potential to, for example, a positive potential when the signals are greater than the comparison signals $v_1$, $v_2$, $v_3$—that is to say when the accelerations fall below the threshold values. In this way, the comparison signals $v_1$, $v_2$, $v_3$ form threshold values which correspond to acceleration limit values in a respective spatial direction. In this case, if the acceleration in one spatial direction, for example in the direction of flight, falls below the limit value, then the signal at the output 42 rises above the comparison signal $v_1$, and the output voltage from the comparator 50 is positive.

The limit values are each below the earth's acceleration due to gravity by a defined value, such that an acceleration state which is below the earth's acceleration due to gravity by a defined further value is present in any case when the accelerations in all three spatial directions fall below their limit values. For example, if the limit value in the direction of flight is 0.14 $m/s^2$ and the limit value for the two other spatial directions is 0.1 $m/s^2$ in each case, then the total acceleration when the enable signal is present is $<0.2$ $m/s^2$.

An AND circuit is formed by connecting the comparators 50, 52, 54 and the voltage source 72 in parallel. If only one of the comparators 50, 52, 54 has a positive output signal, that is to say only one acceleration value is below the limit value, then the signal on the output line 70 is negative, since it is kept negative by the two other comparators 50, 52, 54. If the outputs of two comparators 50, 52, 54 are positive, a voltage source 72 then ensures that the signal on the output line 70 is likewise negative or is at a corresponding electrical potential. Therefore, the signal on the output line 70 is also positive only when all three outputs of the comparators 50, 52, 54 are positive.

The positive signal therefore reaches the timing element 56, which is formed by the resistor 58 and the capacitor 60, such that the positive signal on the output line 70 is blocked during a time period which is defined in advance, such that it does not reach the line 74. By way of example, the time period may be a few seconds, for example 1-5 seconds. Only after this time period is the capacitor 60 charged and the signal is present on the line 74. In consequence, the potential on the line 74 is higher than the comparison signal $v_4$ at the comparator 62. The output of the comparator 62 changes for example, from a negative to a positive potential and in this way produces an enable signal to the output stage 64, which passes on the enable signal in the same form or a different form to the process means 34, to be precise in two outputs, on the one hand as a positive signal and additionally, for safety, as a negative signal.

When the enable signal is present, the process means 34 produces the control signal for operating the mechanism 32 and for enabling the interruption means 30 and the firing chain. Alternatively, it is possible for the enable signal to be passed on directly to the mechanism 32 and the interruption means 30, in order to enable the firing chain. Alternatively, it is possible for the output stage 64 itself to output the control signal, without any need for the process means 34 for this purpose. In this case, the output stage 64 may itself be understood as being the process means.

Furthermore, the process means 34 is connected directly to the output 42 of the sensor 40 and in this way monitors the acceleration value of the sensor 40 in the direction of flight. The monitoring is directed at an absolute minimum in the profile of this acceleration value, expediently with only that frequency part, for example of a Fourier spectrum of the signal on the output 42, at a frequency in the region greater than one second being used for evaluation of the absolute minimum, for example.

The identification of the minimum indicates that the apex point on the projectile path has been flown through, and, in a further exemplary embodiment, the presence of this minimum is used as a further safety criterion for production of the control signal on the signal line 36. Therefore, if only the enable signal from the output stage 64 is present and the minimum has not yet been identified, then no control signal is passed to the mechanism 32. Only when the minimum has been identified and the enable signal from the output stage 64 was present at the process means 34 for a period which is greater than a predetermined limit value, which may be in the range from 1 to 5 seconds, is the control signal passed to the signal line 36.

The safety unit 2 can use the self-test unit 66 for checking. For this purpose, a switch 76 is closed by the controller 68 and the potential on the line 74 is kept permanently at, for example, a negative potential. The command for a self-test such as this is produced by the process means 34 which, for example, reacts to a command from an operator. The controller 64 passes an appropriate signal to the sensor 40, on the basis of which the potentials on the outputs 42, 44, 46 are increased by a predetermined value, corresponding to a very low acceleration. The corresponding values are tapped off by the self-test unit 66 for monitoring, are evaluated, and the result is signaled to the controller 68. Although this results in the positive signal being produced on the output line 70 and possibly being passed on via the timing element 56, the closed switch 76 ensures, however, that the comparator 62 does not produce an enable signal. For safety, the controller 68 passes an additional blocking signal to the output stage 64.

Figure 3:
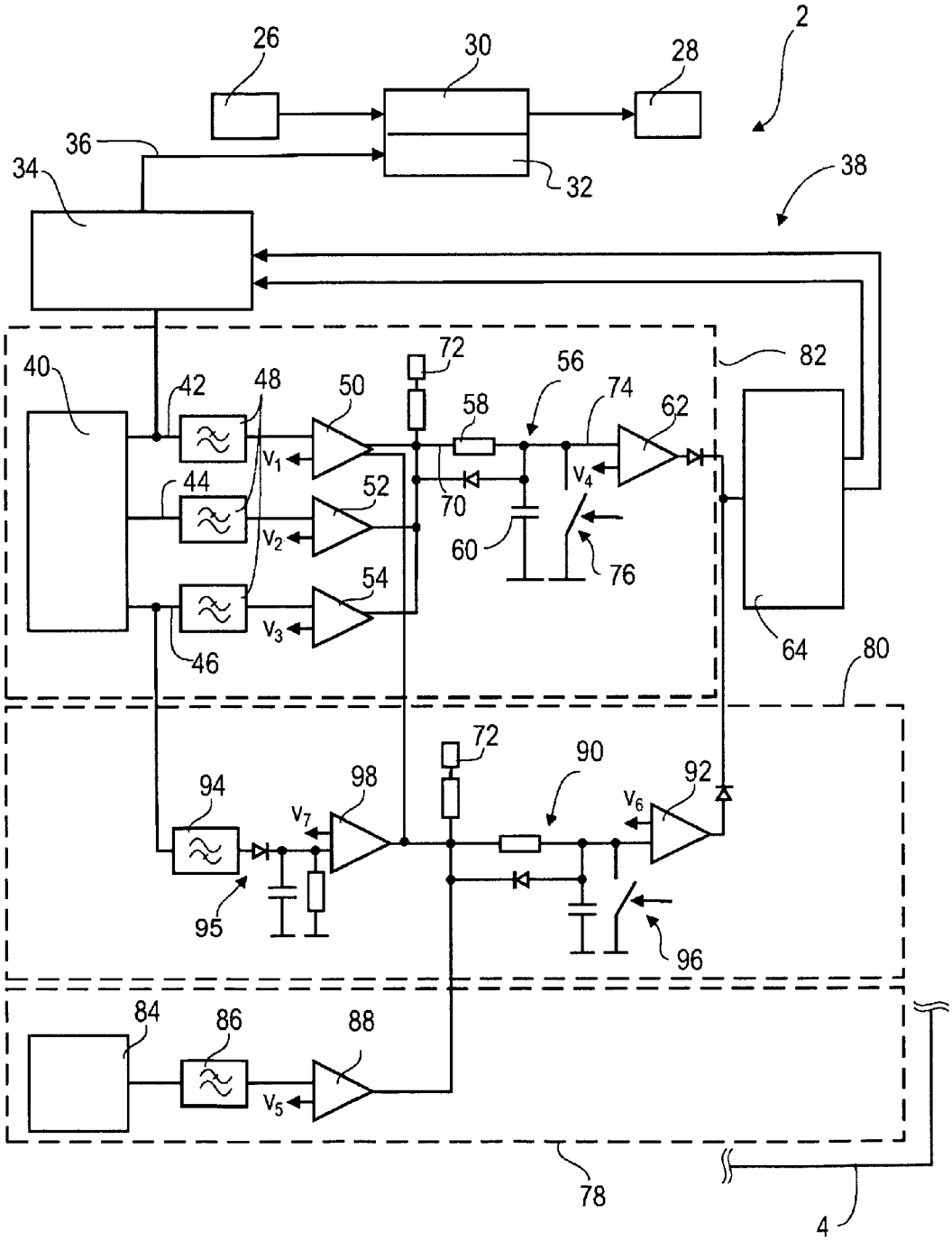
FIG. 3 shows a circuit illustration of an alternative safety device for a fuze.

FIG. 3 shows a further exemplary embodiment, in which the sensor unit 38 illustrated in FIG. 2 has a roll sensor 78 and a ground rolling sensor 80 added to it. For the sake of clarity, the self-test unit 66 and the controller 68 for the sensor unit 38 have not been illustrated, although both units may, of course, be present. All the illustrated components are part of the fuze 4, which is also indicated in FIG. 3.

The following description is restricted essentially to the differences from the exemplary embodiment illustrated in FIG. 2, to which reference is made with respect to features and functions which remain the same. Parts which remain essentially the same are in principle annotated with the same reference symbols, and features which are not mentioned are adopted in the following exemplary embodiments without being described once again.

As is indicated in FIG. 3, the sensor unit 38 comprises a roll sensor 78, a ground rolling sensor 80 and a low-g sensor 82, which has already been described with reference to FIG. 2 and is the same as that described with reference to FIG. 2. The roll sensor 78 is opposite the low-g sensor 82, in an equivalent manner. The two sensors 82, 78 produce their signals independently of one another, and apply them to the output stage 64, in which case both the low-g signal which the low-g sensor 82 passes to the output stage 64 and the roll signal which the roll sensor 78 passes to the output stage 64 can initiate the control signal for arming of the interruption means 30.

The roll sensor 78 comprises a sensor 84, in this exemplary embodiment a single-axis gyroscope, which detects a rolling movement of the fuze 4 about its roll axis. It is equally possible to use an acceleration sensor which is not arranged on the longitudinal axis of the projectile. The signal from the sensor 84 is filtered by a filter 86, which is a low-pass filter for filtering out disturbance signals, and is passed to a comparator 88. The resultant signal is passed via a timing element 90, which is designed in the same way as the timing element 56, to a comparator 92, which outputs the roll signal. Although the timing element 90 and the comparator 92 are also used by the ground rolling sensor 80 and are shown as part of the ground rolling sensor 80, they may, however, just as well be parts of the roll sensor 78.

During rolling of the projectile or of the fuze 4, the sensor 84 produces a signal which corresponds to the roll rate, that is to say the speed of revolution of the fuze 4 about the roll axis or longitudinal axis of the fuze 4 or projectile. The signal increases as the roll rate rises. The signal is compared by the comparator 88 with a comparison signal $v_5$. If the signal increases above the comparison signal $v_5$, then the comparator 88 outputs a positive signal, or the signal from the comparator 88 changes from a negative or low value to a positive or higher value. In this case, the comparison signal $v_5$ is chosen such that the roll signal becomes positive only at a defined roll rate, for example of 2 Hz. Below this defined roll rate, the lateral acceleration, which acts as a disturbance acceleration and which the sensor 40 experiences because of an unbalance in the projectile, is so low that it is possible to preclude the possibility of the low-g signal remaining off, caused by the unbalance, resulting from defined projectile manufacturing tolerances.

The timing element 90 checks whether the roll signal is present without interruption for more than a defined time period which, for example, may be in the range from 1 to 5 seconds. Only if this is the case is the roll signal passed to the comparator 92, is enabled there—analogously to the comparator 62, and is passed to the output stage 64.

The low-g signal from the low-g sensor 82 and the roll signal from the roll sensor 78 are treated equivalently in the output stage 64. If one of the two signals is present, then the output stage 64 and the process means 34 react as described with reference to FIG. 2, and the control signal is output in order to arm the interruption means 30. Therefore, the low-g signal and the roll signal are linked to one another in an OR logic operation such that the presence of one of the two signals is checked. The control signal can therefore also be initiated when both signals are present at the same time, as is normally the case, that is say when there is little unbalance in the projectile.

Initiating of the control signal for arming of the interruption means 30 should absolutely be prevented when the projectile is rolling on the ground and is not in the "flight" state, that is to say it is not flying freely. However, the roll sensor 78 cannot distinguish whether the rolling movement is caused by uniform rolling on the ground or rolling in free-flight. It therefore outputs the roll signal even when rolling on the ground.

In order to prevent such undesirable arming, the sensor unit 38 is equipped with the ground rolling sensor 80, which identifies that the projectile is rolling on the ground. The ground rolling sensor 80 serves as an input signal from an output of the sensor unit 20, specifically a signal at the output 44 or 46 or both outputs 44, 46, which reflect the lateral acceleration.

If the projectile is rolling on the ground, then both of these sensors of the sensor unit 40 which measure the lateral accelerations output an alternating signal, since they measure the earth's acceleration due to gravity downwards. Since the sensor unit 40, at least its two sensors which measure the lateral acceleration, is arranged on the geometric axis of the projectile, the roll rate has virtually no effect on the amplitude of the alternating signal, since the sensor unit 40 does not measure centrifugal force. The alternating signal is filtered by a filter 94, which is a high-pass filter, such that only high-frequency components of the alternating signal above a predetermined frequency, for example 2 Hz, pass through the filter. In this way, only ground rolling above the predetermined frequency is identified.

A rectification smoother 95 converts the alternating signal to a simply smoothed DC voltage signal which is now applied to the comparator 98. Rolling of the projectile on a base results in an alternating signal at the roll frequency and with the amplitude which corresponds to approximately 1 g being applied to the input of the filter 94. The rectification smoother 95 at least essentially eliminates the frequency information, since the alternating signal is converted to a DC voltage. During ground rolling, for example on a flat surface, the magnitude of the DC voltage signal corresponds to the total acceleration value of approximately 1 g, and is therefore independent of the nature of the rolling. When not rolling on the ground, or when rolling on the ground below the predetermined frequency, no signal is applied to the comparator 98, apart from disturbance signals which may be caused, for example, by shaking of the projectile. Disturbance signals which result from lateral movements of the projectile below a predetermined acceleration, for example below 0.5 g, are blocked by the comparator 98.

When the projectile is rolling over a base, the roll sensor 78 outputs a positive roll signal. At the same time, the comparator 98 outputs a ground rolling signal, which indicates ground rolling. The ground rolling signal is a negative signal which overrides the roll signal from the roll sensor 78, such that no sufficiently positive signal can be applied to the comparator 92. The enabling of the roll sensor 78 is therefore blocked by the ground rolling sensor 80.

For additional safety, the output signal from the comparator 50, which indicates acceleration in the direction of flight, is reflected on the roll signal. This signal also overrides the roll signal. For example, if a roll signal, that is to say a positive signal, is output that the longitudinal acceleration of the fuze 4 is not below the limit value, then this is an indication that the projectile is not in free flight. Correspondingly, the signal from the comparator 50 is zero or negative and overrides the positive roll signal, such that this cannot initiate the control signal for arming of the interruption means.

The combination of the roll sensor 78 and ground rolling sensor 80 may also be subjected to a self-test, as described with reference to FIG. 1. For this purpose, the switch 96 is closed and the sensor 84 is operated by the process means 34 or the controller 68 such that the roll sensor outputs the roll signal, and the ground rolling sensor 80 outputs the ground rolling signal at the same time and/or with a time offset.

LIST OF REFERENCE SYMBOLS

2 Safety device
4 Fuze
6 Safety means
8 Safety means
10 Safety means
12 AND Logic
14 AND Logic
16 Safety means
18 Means
20 Fire signal
22 AND Logic
24 Firing
26 Firing means
28 Firing means
30 Interruption means
32 Mechanism
34 Process means
36 Signal line
38 Sensor unit
40 Sensor
42 Output
44 Output
46 Output
48 Filter
50 Comparator
52 Comparator
54 Comparator
56 Timing element
58 Resistor
60 Capacitor
62 Comparator
64 Output stage
66 Self-test unit
68 Controller
70 Output line
72 Voltage source
74 Line
76 Switch
78 Roll sensor
80 Ground rolling sensor
82 Low-g sensor
84 Sensor
86 Filter
88 Comparator
90 Timing element
92 Comparator
94 Filter
95 Rectification smoother
96 Switch
98 Comparator

The invention claimed is:

1. A safety device for a fuze of a projectile having a firing device for firing the fuze, the safety device comprising:

a safety unit having a processor configured for setting a safety for a firing process of the firing device;

a sensor unit configured to output an enable signal when an acceleration state is registered that lies below the earth's acceleration due to gravity, said sensor unit being configured to measure three directional accelerations in three mutually orthogonal spatial directions, and wherein the enable signal is output at a time at which each of the three directional accelerations lies below the earth's acceleration due to gravity, at least by a respectively defined acceleration value;

said processor being connected to receive the enable signal and configured to output a control signal arming said safety unit in dependence on a presence of the enable signal.

2. The safety device according to claim 1, wherein the defined acceleration value is different in a direction of flight of the projectile than the defined acceleration value in the two other directions.

3. The safety device according to claim 1, wherein the defined acceleration state is below the earth's acceleration due to gravity by at least one defined acceleration value, and the sensor unit comprises at least one comparator by way of which the acceleration value can be adjusted.

4. The safety device according to claim 1, which comprises a timing element for presetting a time interval, and wherein said processor outputs the control signal only when the enable signal has been present without interruption throughout the entire time interval.

5. The safety device according to claim 1, wherein said sensor unit includes a roll sensor configured to identify rolling of the projectile and to output a roll signal when a rolling movement is present.

6. The safety device according to claim 5, wherein said processor is configured to check for a presence of both the enable signal and the roll signal, and to output the control signal to arm the safety unit if at least one of the enable or roll signals is present.

7. The safety device according to claim 5, wherein said processor is configured to check, when the roll signal is present, whether a magnitude of the acceleration of the projectile in the axial direction lies below a predetermined value, and to output the control signal for arming only when the value has been undershot.

8. The safety device according to claim 5, wherein said roll sensor is an acceleration sensor.

9. The safety device according to claim 5, wherein said processor is configured to distinguish between free-flight rolling of the projectile and rolling of the projectile on a base.

10. The safety device according to claim 1, wherein said sensor unit includes a ground rolling sensor configured to identify ground rolling of the projectile on a base, and to output a ground rolling signal when ground rolling is detected.

11. The safety device according to claim 10, wherein said processor is configured to suppress an output of the control signal for arming when the ground rolling signal is present.

12. The safety device according to claim 1, wherein:

said sensor unit is configured to measure three directional accelerations in three mutually orthogonal spatial directions, and the enable signal is output at a time at which each of the three directional accelerations lies below the earth's acceleration due to gravity, in each case at least by a defined acceleration value, and said sensor unit further includes:

a roll sensor configured to identify rolling of the projectile and to output a roll signal when a rolling movement is present; and a ground rolling sensor configured to identify ground rolling of the projectile on a base and to output a ground rolling signal during ground rolling;

said processor is configured to carry out the following process steps:

checking both the enable signal and the roll signal for a presence thereof and, if at least one of the two signals is present, outputting the control signal for arming the safety unit; but when the roll signal is present, to additionally check whether a magnitude of the acceleration of the projectile in the axial direction lies below a predetermined value, and to output the control signal for arming only when the value is undershot; and distinguishing between free-flight rolling of the projectile and ground rolling of the projectile on the ground, and to suppress an output of the control signal for arming when the ground rolling signal is present.

13. The safety device according to claim 1, wherein the firing device has a firing chain with a firing charge for firing the fuze, and said safety unit includes an interruption means for interrupting the firing chain.

14. A method for arming a fuze of a projectile having a firing device for firing the fuze and a safety device with a safety unit which contains a processor for making a firing process of the firing device safe, the method which comprises:

measuring three directional accelerations in three mutually orthogonal spatial directions with a sensor unit;

outputting with the sensor unit, an enable signal when a defined acceleration state occurs that lies below the earth's acceleration due to gravity at a time at which each of the three directional accelerations lies below the earth's acceleration due to gravity, at least by a respectively defined acceleration value; and receiving the enable signal with the processor and outputting a control signal for arming the safety unit in dependence on a presence of the enable signal.

* * * * *